US005887871A

United States Patent [19]

Zappolo

[11] Patent Number: 5,887,871

[45] Date of Patent: Mar. 30, 1999

[54] GAME BOARD WITH OBSTACLES

[76] Inventor: Len Zappolo, 700 Outpost Cir., Wayne, Pa. 19087

[21] Appl. No.: 3,023

[22] Filed: Jan. 5, 1998

[51] Int. Cl.[6] ..... A63F 3/00

[52] U.S. Cl. ..... 273/236; 273/441

[58] Field of Search ..... 273/236, 251, 273/252, 254, 441

[56] References Cited

U.S. PATENT DOCUMENTS

| | | | |
|---|---|---|---|
| 565,235 | 8/1896 | Sargent | 273/441 X |
| 622,858 | 4/1899 | Jewell | 273/441 X |
| 1,455,045 | 5/1923 | Conde | 273/252 |
| 3,458,198 | 7/1969 | De Lucia et al. | 273/441 |
| 4,054,287 | 10/1977 | Barkett | 273/254 |
| 4,076,250 | 2/1978 | Azcarate | 273/251 |
| 4,087,094 | 5/1978 | Bakay | 273/254 |
| 5,004,246 | 4/1991 | Merrill et al. | 273/251 X |
| 5,314,188 | 5/1994 | Mason et al. | 273/251 |

*Primary Examiner*—William E. Stoll
*Attorney, Agent, or Firm*—John Lezdey & Assoc.

[57] ABSTRACT

A portable board game simulating a street for competitive play by from two to six players. The playing surface includes a series of twelve sequentially numbered landing spaces which must be progressively negotiated by having a playing piece successfully land totally within each numbered space in sequential order to complete the game. The board includes a series of obstacles of the type found on a city street or highway which are positioned to interfere with a game piece as it is moved from one numbered space to a succeeding numbered space. The obstacles include, for example, a raised manhole cover plate, a speed bump, a pair of barrier cones and at least two pot holes which form depressions or recesses in the surface of the board similar to potholes formed in a roadway. The board also includes a centrally positioned "dead box" which serves as a penalty zone, penalizing a player whose game piece lands in the dead box. The game piece is moved by striking with a finger or with a striking object such as a stick.

12 Claims, 1 Drawing Sheet

GAME BOARD WITH OBSTACLES

FIELD OF THE INVENTION

The present invention relates to board games and in particular to a board game for moving a game piece around a plurality of obstacles found on a city street.

BACKGROUND OF THE INVENTION

Board games for moving game pieces along a predetermined path are well known in the art. For example, U.S. Pat. No. 4,550,917 to Ferris et al relates to a racing board game using a dual track and blocking pieces. U.S. Pat. No. 5,004,246 to Merrill et al relates to a white-water rafting game having a variety of hazards. U.S. Pat. No. 5,139,267 to Trevisan relates to a racing game having bonus points or penalties received depending on the particular space occupied by the player during the course of the game.

The present invention is directed to a portable board game for competitive play by from two to six players. The playing surface includes a series of twelve squares or landing spaces which must be progressively negotiated by having a playing piece successfully land totally within each numbered space in sequential order to complete the game. The board includes a series of obstacles of the type which may be found on a city street or highway which are positioned to interfere with a game piece as it is moved from one numbered space to a succeeding numbered space. The obstacles include, for example, a raised manhole cover plate, a speed bump, a pair of barrier cones and at least two pot holes which form depressions or recesses in the surface of the board similar to potholes formed in a roadway.

The board also includes a centrally positioned "dead box" which serves as a penalty zone, penalizing a player whose game piece lands in the dead box. If a game piece lands in a pot hole it may be removed upon penalty of the loss of one turn. If a piece lands in the dead box, the player receives a penalty of the loss of two or three turns depending upon the penalty agrees upon at the start of the game. Preferably, the sequentially numbered spaces are disposed at opposite locations on the board usually with at least one or more obstacles in between to limit accessibility therebetween. For example, space 1 is located at one corner of the board and space 2 is located at a diagonally opposite corner with two potholes and the dead box directly in line with the two spaces. Spaces 3 and 4 are located at the other two diagonally opposite corners with the dead box and a manhole cover plate in line therewith. Spaces 5, 6, 7, and 8 are centrally located on opposite sides of the board directly in line with the dead box. Spaces 9 and 10 are centrally located on opposite ends of the board with the speed bump and dead box therebetween. Spaces 11 and 12 are located directly adjacent opposite ends of the dead box.

To play a dead box game each player rolls a die with the highest number going first. The first player moves his game piece from the starting point between landing spaces 2 and 4 located on an opposite end of the board, toward a first numbered space 1 by a flick of the players finger or by rapidly pushing the piece in the target direction with an object such as a cue stick used in billiards. If the piece lands totally within the numbered space, the player continues to move the piece toward the space 2. If at any time the piece does not land within the numbered space, either by miscalculation of the movement or by hitting an obstacle, the player's turn ends and the next player repeats the moves with his or her own piece. If a piece lands either partially or wholly within a pothole, that player loses a turn as a penalty.

The piece is then removed to a far end of the board surface. If a piece lands within the dead box, the player loses two or three turns, depending upon the number agreed to at the start of the game. If a piece is shot completely off the board, a player may replace the piece at the point it left the board but with a penalty of one lost turn. An opposing player may aim his own piece at an opponent's piece to deflect that piece either into a penalty location or in a direction opposite the intended target landing space. The player can continuously hit his opponents piece to gain another turn and to advance his own piece. There are no limitations as to the direction the piece may be moved as long as the next succeeding landing space is entered. For example, a piece located directly behind an obstacle or in danger of going into the dead box penalty zone, may be aimed in another direction and, for example, may be played off of one of the side or end walls.

The game requires a degree of skill to completely negotiate all of the numbered spaces from 1 to 12. A player must also develop proficiency in avoiding the various obstacles while the piece is moved. The game is considered over when one of the players successfully completes all of the numbered spaces. If a series of games are played, penalty points may be assessed a player depending upon the number of remaining spaces the player has to negotiate. Obviously the player with the least number of points would be declared the winner at the end of a multiple game series.

The object of the game is to move a playing piece from successive numbered spaces in the least number of moves while avoiding the various obstacles on the board which are placed in the way of the game piece.

Another object is to proficiently move a game piece with a player's finger or striking stick to sequentially numbered target landing spaces, while avoiding obstacles in the path.

These and other objects will become apparent with reference to the following drawings and accompanying specification.

DESCRIPTION OF THE PREFERRED EMBODIMENTS

Figure 1:
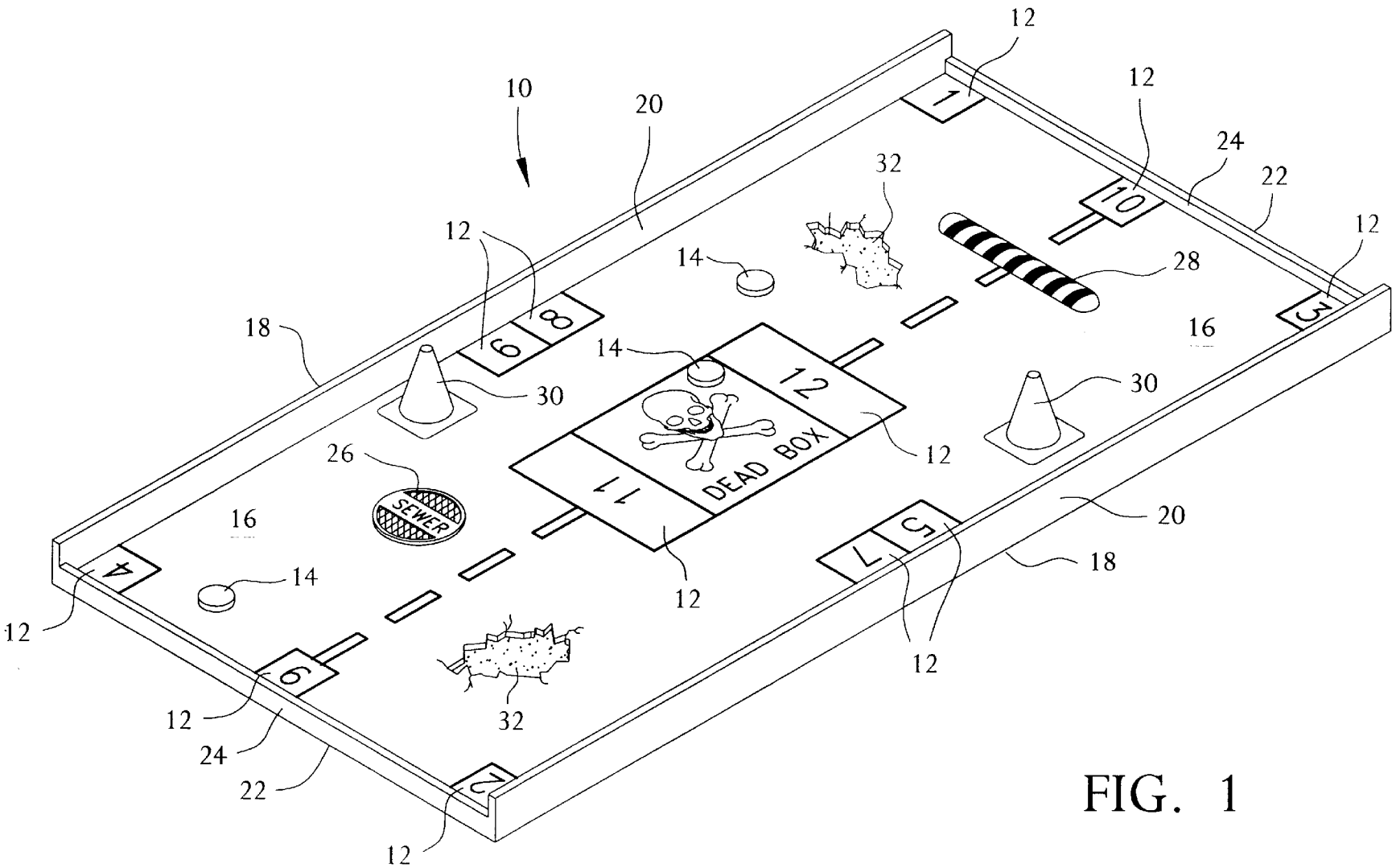
FIG. 1 is a perspective view of a game board in accordance with the present invention.

Referring to the drawings, FIG. 1 illustrates a game board 10 in accordance with the present invention. The game board 10 may be about 3 by 5 feet in size or even larger. The game board is designed to be portable and placed either on a table or similar support surface or on a floor. The game board 10 includes a series of numbered spaces 12 which are sequentially numbered from 1 to 12. Each space 12 is sufficiently large to accommodate a game piece 14 within its borders. The game piece 14 may be a token, coin, bottle top, checker or any other similar round, flat piece capable of being moved across the surface 16 of the game board 10 and sized to fit within the numbered spaces 12. The sides 18 of the game board include upright walls 20 extending longitudinally along the length of each side 18. Ends 22 of the game board 10 include upright walls 24 which are approximately one half the height of the walls 20 along the sides 18. The side walls 20 and end walls 24 act to retain the game pieces 14 on the game surface 16 of the game board 10. The game board 10 includes a plurality of obstacles including a raised manhole cover plate 26, a speed bump 28, a pair of barrier cones 30 and a pair of potholes 32. The manhole cover plate 26, the speed bump 28 and the cones 30 are raised above the board game surface 16. A game piece 14 which encounters one of these raised obstacles will either be stopped or deflected causing it to alter its direction of travel. The potholes 32 are formed by depressions or recesses in the surface 16 of the game board 10 and actually impede the path of a game piece 14 which might pass over a pothole 32. A game piece 14 having a relatively slow movement will be stopped by a pothole 32. If the piece 14 stops either wholly or partially within a pothole 32, the player is penalized one turn to remove the piece 14. The piece 14 must be placed on an end of the board 10 furthest from the intended target landing space 12 as part of the penalty.

The center of the game board 10 is provided with a penalty zone 34 called a "dead box". If a player's game piece 14 lands on the dead box penalty zone 34, that player loses at least two turns or more depending upon the number agreed on at the start of the game.

Preferably, a first square or space numbered "1" is positioned at one of the corners of the game board 10. The next numbered space 2 is positioned at an opposite diagonal corner on the game board 10. In order to move a game piece from space 1 to space 2 at least some of the obstacles must be negotiated. As can be seen from the drawing, potholes 32 as well as the dead box penalty zone 34 must be crossed. Landing space 2 is separated from space 3 by a barrier cone 30. In a like arrangement, space 3 is positioned at an opposite corner from space 4. The dead box penalty zone 34 and the manhole cover plate 26 must be negotiated in order to move the game piece to the target landing space 4. Spaces 5, 6, 7, and 8 are positioned on opposite side walls 18 of the game board 10 requiring that the dead box penalty zone 34 be crossed to move the game piece 14 to the next succeeding numbered landing spaces. Spaces 9 and 10 are located on opposite ends 22 of the game board 10 and the game piece 14 must cross over the dead box penalty zone 34 as well as the speed bump 28. Spaces 11 and 12 are located adjacent the ends of the dead box penalty zone 34 so it must be crossed in order that a piece 14 be positioned in spaces 11 and 12 to end the game.

Once the sequence of play is established, by the roll of a die, spinner or other means, the first player sets his piece 14 at the end of the board 10 between numbered landing spaces 2 and 4 opposite landing space 1. The player moves his piece by flicking his finger against the edge of the game piece 14 propelling it toward the target landing space 1. Alternatively, the game piece may be moved by striking such as with a cue stick. In executing the flicking or hitting motion, the player must take care to insure the game piece avoids the various obstacles in his path and also that the total distance the piece 14 is moved allows it to finish its travel close to, if not in, the numbered target landing space 12. If the game piece does not finish totally within the landing space 12, the turn is over and the next player begins his turn. It will be appreciated that a player may aim his piece 14 at an opponent's piece, to either send the opponent's piece off course or into a penalty zone. If a piece 14 ends up close to a targeted landing space 12, a player may move it into the space using a short pushing motion or jab insuring that his or her finger or cue stick makes only slight contact with the game piece 14.

If a piece 14 finishes its travel touching the dead box penalty zone 34, the player may lose two or more turns, as agreed upon by the players prior to the start of the game.

Up to six players may play the game at the same time by taking turns in order. When as many as six game pieces 14 are on the board 10, in addition to the obstacles, a player must use a well thought out strategy to insure his game piece 14 avoids, not only the obstacles, but uses the other game pieces to further his own advancement or place the other player in a penalty zone.

Therefore, it can be seen that there is provided a method of playing a game utilizing the aforementioned game board which comprises:

a) determining the order of play of a plurality of players;

b) manually projecting a game piece with a finger or striking stick by a first player from a starting position on the board which avoids obstacles and the penalty zones;

c) repeating the manual projecting move until the game piece is completely located within the landing space;

d) projecting the game piece from the first landing space to the next sequentially numbered landing space while avoiding obstacles and the penalty zones; and e) repeating the projection steps until a piece completely negotiates all of the sequentially numbered landing spaces.

The method further includes attacking the other game pieces to advance a game piece or to place an opponent into a penalty zone or obstacle.

The above description is not intended to be limiting. For example other different obstacles which are stationary or movable, such as wrecked vehicles, guard rails, road wash outs or other penalty zones may be provided. The game may include pusher sticks which are used to move the game pieces instead of using a player's fingers. Still other changes may be made in keeping within the spirit and scope of the present invention as defined in the appended claims.

What is claimed is:

1. A board game having a playing surface simulating a street for at least two players comprising: a plurality of sequentially numbered landing spaces positioned at different locations of said playing surface; a game piece for each player movable along the board by striking and sized to fit within said landing spaces; a plurality of obstacles located on said playing surface simulating a street hazard for providing barriers to the movement of said game piece on said playing surface; and at least one penalty zone centrally located on said playing surface.

2. The board game of claim 1 wherein said obstacles are further defined as including at least one obstacle raised above said playing surface.

3. The board game of claim 1 wherein said obstacles are further defined as including at least one obstacle forming a recess below said playing surface.

4. The board game of claim 1 wherein said obstacles are further defined as simulating obstacles encountered on a roadway.

5. The board game of claim 1 wherein said obstacles include potholes forming a recess in said playing surface.

6. The board game of claim 1 wherein said obstacles further include raised barriers above said playing surface.

7. The board game of claim 1 wherein said obstacles are further defined as at least one speed bump, at least one barrier cone and at least one manhole cover plate.

8. The board game of claim 1 wherein said sequential pairs of said numbered landing spaces are located on opposite ends of said game board and said obstacles are located therebetween.

9. The board game of claim 1 wherein said penalty zone is located centrally on said playing surface.

10. The board game of claim 9 further including additional penalty zones located displaced from said centrally located penalty zone on said playing surface.

11. A board game having a playing surface simulating a street for at least two players comprising: a plurality of sequentially numbered landing spaces positioned at different locations on said playing surface; a game piece for each player movable along the board by striking and sized to fit within said landing spaces; a plurality of obstacles located on said playing surface, said obstacles being further defined as simulating obstacles encountered on a roadway and providing barriers to the movement of said game piece on said playing surface; said obstacles including at least one obstacle raised above said playing surface and including at least one obstacle forming a recess below said playing surface; and at least one penalty zone centrally located on said playing surface; whereby said game piece is sequentially moved from one sequentially numbered landing space to another sequentially numbered landing space in the least amount of moves while avoiding said obstacles and said penalty zone.

12. The board game of claim 11 wherein said obstacles include potholes forming a recess in said playing surface; said obstacles further include at least one speed bump, at least one barrier cone and at least one manhole cover plate.

* * * * *